US011024273B2

(12) United States Patent
Luzzatto

(10) Patent No.: US 11,024,273 B2
(45) Date of Patent: Jun. 1, 2021

(54) METHOD AND APPARATUS FOR PERFORMING MELODY DETECTION

(71) Applicant: MELOTEC LTD., Tel-Aviv Yafo (IL)

(72) Inventor: Ariel Luzzatto, Holon (IL)

(73) Assignee: MELOTEC LTD., Tel-Aviv Yafo (IL)

( * ) Notice: Subject to any disclaimer, the term of this patent is extended or adjusted under 35 U.S.C. 154(b) by 0 days.

(21) Appl. No.: 16/628,725

(22) PCT Filed: Jul. 2, 2018

(86) PCT No.: PCT/IL2018/050716
§ 371 (c)(1),
(2) Date: Jan. 6, 2020

(87) PCT Pub. No.: WO2019/012519
PCT Pub. Date: Jan. 17, 2019

(65) Prior Publication Data

US 2020/0193946 A1 Jun. 18, 2020

(30) Foreign Application Priority Data

Jul. 13, 2017 (IL) ..... 253472

(51) Int. Cl.
*G10H 1/00* (2006.01)
*G10G 1/04* (2006.01)

(52) U.S. Cl.
CPC ..... *G10H 1/0008* (2013.01); *G10G 1/04* (2013.01); *G10H 2210/061* (2013.01); *G10H 2210/086* (2013.01); *G10H 2250/235* (2013.01)

(58) Field of Classification Search
CPC ..... G10H 1/0008; G10H 2210/061; G10H 2210/086; G10H 2250/235; G10G 1/04
See application file for complete search history.

(56) References Cited

U.S. PATENT DOCUMENTS 5,038,658 A * 8/1991 Tsuruta ..... G10G 3/04 84/461
5,210,366 A * 5/1993 Sykes, Jr. ..... G10H 1/0033 84/616
6,124,544 A * 9/2000 Alexander ..... G10H 3/125 84/616
6,633,845 B1 * 10/2003 Logan ..... G10H 1/0008 400/116
7,493,254 B2 * 2/2009 Jung ..... G10L 25/90 704/205
8,193,436 B2 * 6/2012 Sim ..... G10H 1/00 84/616
8,309,834 B2 * 11/2012 Gehring ..... G10H 1/383 84/613

(Continued)

OTHER PUBLICATIONS

International Search Report for PCT/IL2018/050716, dated Oct. 4, 2018; 4 pages.

(Continued)

*Primary Examiner* — Jeffrey Donels
(74) *Attorney, Agent, or Firm* — Roach, Brown, McCarthy & Gruber, P.C.; Kevin D. McCarthy

(57) ABSTRACT

A method for performing melody detection comprises interpreting the global perceptual effect of all the sounds at once, to determine what is the melody actually perceived by the human ear, and providing a music sheet or a text printout including a time sequence of single notes describing that melody.

20 Claims, 7 Drawing Sheets

(56) References Cited

U.S. PATENT DOCUMENTS

| | | | | |
|---|---|---|---|---|
| 9,471,673 | B1 | 10/2016 | Sharifi et al. | |
| 9,653,095 | B1 * | 5/2017 | Tcheng | G10H 1/40 |
| 2006/0064299 | A1 * | 3/2006 | Uhle | G06K 9/6242 704/212 |
| 2006/0075884 | A1 | 4/2006 | Streitenberger et al. | |
| 2008/0202321 | A1 * | 8/2008 | Goto | G10H 1/361 84/616 |
| 2009/0119097 | A1 * | 5/2009 | Master | G10H 1/0008 704/207 |
| 2013/0339035 | A1 * | 12/2013 | Chordia | G10L 19/02 704/500 |
| 2014/0338515 | A1 * | 11/2014 | Sheffer | G10H 1/0025 84/609 |
| 2016/0019878 | A1 * | 1/2016 | Brown | G10L 25/18 381/99 |
| 2017/0243571 | A1 * | 8/2017 | Cogliati | G10G 1/04 |

OTHER PUBLICATIONS

Written Opinion of the International Searching Authority for PCT/IL2018/050716, dated Oct. 4, 2018; 6 pages.

Communication and Supplementary Partial European Search Report for European application No. 18 83 2959, dated Mar. 12, 2021 (14 pages).

Paiva et al., "Melody Detection in Polyphonic Musical Signals: Exploiting Perceptual Rules, Note Salience, and Melodic Smoothness", Computer Music Journal, 30:4, pp. 80-98, Winter 2006, (19 pages).

Benetos et al., "Joint Multi-pitch Detection using Harmonic Envelope Estimation for Polyphonic Music Transcription", IEEE Journal of Selected Topics in Signal Processing, 5(6): 1111-1123, Oct. 2011 (13 pages).

* cited by examiner $S = f_s \times T$ : $S$ = Frame size in samples $T$ = Frame duration $f_s = 1/t_s$ Sampling rate

| Key# | Coefficient | Frequency |
|---|---|---|
| 1 | 0.02 | 138 Hz |
| 7 | 0.096 | 195 Hz |
| 14 | 0.21 | 293 Hz |
| 19 | 0.31 | 391 Hz |
| 35 | 0.86 | 987 Hz |
| 39 | 1.0 | 1244 Hz |
| 43 | 0.63 | 1567 Hz |
| 47 | 1.0 | 1975 Hz |
| 51 | 1.92 | 2489 Hz |
| 54 | 2.2 | 3135 Hz |
| 57 | 2.5 | 3520 Hz |

| | 1 | 2 | 3 | 4 | 5 | 6 | 7 | 8 | 9 | 10 | 11 | 12 | 13 | 14 | 15 | ..... | 20 | 21 | 22 | ..... | 25 | 26 | 27 | ..... | 58 | 59 | 60 |
|---|---|---|---|---|---|---|---|---|---|---|---|---|---|---|---|---|---|---|---|---|---|---|---|---|---|---|---|
| 1 | 1 | 0 | 0 | 0 | 0 | 0 | 0 | 0 | 0 | 0 | 0 | 0 | 1 | 0 | 0 | 000 | 1 | 0 | 0 | 000 | 1 | 0 | 0 | 000 | 0 | 0 | 0 |
| 2 | 0 | 1 | 0 | 0 | 0 | 0 | 0 | 0 | 0 | 0 | 0 | 0 | 0 | 1 | 0 | 000 | 0 | 1 | 0 | 000 | 0 | 1 | 0 | 000 | 0 | 0 | 0 |
| 3 | 0 | 0 | 1 | 0 | 0 | 0 | 0 | 0 | 0 | 0 | 0 | 0 | 0 | 0 | 1 | 000 | 0 | 0 | 1 | 000 | 0 | 0 | 1 | 000 | 0 | 0 | 0 |
| . | . | . | . | . | . | . | . | . | . | . | . | . | . | . | . | . | . | . | . | . | . | . | . | . | . | . | . |
| . | . | . | . | . | . | . | . | . | . | . | . | . | . | . | . | . | . | . | . | . | . | . | . | . | . | . | . |
| . | . | . | . | . | . | . | . | . | . | . | . | . | . | . | . | . | . | . | . | . | . | . | . | . | . | . | . |
| 59 | 0 | 0 | 0 | 0 | 0 | 0 | 0 | 0 | 0 | 0 | 0 | 0 | 0 | 0 | 0 | 000 | 0 | 0 | 0 | 000 | 0 | 0 | 0 | 000 | 0 | 1 | 0 |
| 60 | 0 | 0 | 0 | 0 | 0 | 0 | 0 | 0 | 0 | 0 | 0 | 0 | 0 | 0 | 0 | 000 | 0 | 0 | 0 | 000 | 0 | 0 | 0 | 000 | 0 | 0 | 1 |

*Fig. 8*

METHOD AND APPARATUS FOR PERFORMING MELODY DETECTION

FIELD OF THE INVENTION

The present invention relates to musical aids. More particularly, the invention relates to the detection of melody from played music.

BACKGROUND OF THE INVENTION

At each instant in time, a piece of music consists of a multitude of sounds generated by a variety of acoustic sources acting simultaneously, including various musical instruments, human voices, percussion instruments, possibly corrupted by unintentional effects such as instrument mistuning, background noise, poor recording quality and playback distortion. Some of the above sounds may last for a prolonged period of time, up to several seconds, while other sounds may show up for only a very short time, of the order of less than one tenth of a second. Thus each instantaneous composite sound due to the combination of all the simultaneous sounds present at a given instant, lasts for a time period at most equal to the time period of the shortest sound.

In turn, the sound generated by each one of the sounds sources present at a given instant, is composed by a multitude of periodic sinusoidal components, each one at a different frequency, with different phase and different amplitude. The collection of all the sinusoidal components of a certain source, when heard at once, sounds like the particular instrument/voice that generates them.

At any given instant, the sound of a musical instrument as well as of a human voice, consists of the collection of several sinusoidal components (up to few tens), referred to as the harmonic components (in short "harmonics") of the sound source, whose frequencies are all integer multiples of a basic frequency denoted as the fundamental frequency (in short "fundamental"). When a musical instrument plays a single note, for instance, the middle C which we hear as a sound at frequency $f_0$=261.6 Hz, it in fact simultaneously emits a collection of harmonics at frequencies $f_0$, $2f_0$, $3f_0$, . . . etc., each with different amplitude and phase. The sinusoidal component at frequency $f_0$ is the fundamental component, the component at frequency $2f_0$ is the 2nd harmonic, the component at frequency $3f_0$ is the 3rd harmonic and so on. A collection of such harmonic components, each of arbitrary amplitude and phase, is referred to as a Fourier series.

At any given instant, the fundamental frequency of the Fourier series of a sound source determines the tone we perceive, for instance, whether we hear a bass (lower-frequency) sound or a treble (higher-frequency) sound, while the relative amplitude of the various harmonics in the Fourier series determines the timbre we perceive, namely, whether we hear a violin, a piano, a human voice, or other.

Although the fundamental frequency determines the tone we perceive, the fundamental component itself needs not be present (its amplitude may be zero). In fact, in order for us to hear a tone at the fundamental frequency $f_0$, it suffices that some harmonic components that differ in frequency by $f_0$ be present (for instance second and third harmonics at frequencies $2f_0$ and $3f_0$), while all the other harmonics in the Fourier series, as well as the fundamental component at frequency $f_0$, may be missing. This fact is clearly seen in the lower-frequency piano keys, which sound as bass, while the fundamental component is typically missing, and thus the lowest frequency actually present in the sound is the second harmonic, which is at frequency twice higher than the frequency we perceive.

The human hearing system does not react equally to all frequencies, but behaves according to certain mechanisms referred to as perceptual rules. In particular, up to a certain limit, the human ear is more sensitive to higher frequencies than to lower ones, according to a behavior known as the equal loudness contour (defined in the standard ISO 226: 2003). If a treble note and a bass note have the same amplitude, we perceive the treble sound as being much louder than the bass one. Thus, at a given instant, an instrument playing at lower volume and at higher frequency, may be heard as dominant as compared to an instrument playing at higher volume at lower frequency. Moreover, this perceptual effect applies to each harmonic component separately. Thus, the perceptual power differs from the physical power.

When listening to a piece of music, we hear at once all the harmonics generated by all the instruments playing at a given instant, together with surrounding noise and distortion, and we cannot distinguish which harmonic was generated by which instrument. Our ear will collect all the sounds at the same time, and the combination of the various components will give rise to a multitude of Fourier series, possibly sharing common harmonics, each with his own perceptual loudness, and with harmonic components each possibly arising from a different source. The perceptual loudness of each such Fourier series will be equal to the sum of the individual perceptual powers of the harmonic components in it. In general, our hearing system will perceive the Fourier series with the strongest perceptual loudness as the dominant tone at the given instant. However, the inventor has observed that if two Fourier series have comparable perceptual loudness, the Fourier series with the higher fundamental frequency will be perceived as the dominant one.

It follows from the above that, when listening to a piece of music, the melody we hear is the time sequence of the dominant Fourier series, while such dominant Fourier series may be the result of the combined sounds of different instruments and voices, as well as distortion and noise, rather that the sound of some specific instrument, and there may be no single instrument actually playing the melody.

SUMMARY OF THE INVENTION

The present invention relates to a method and apparatus for performing melody detection, thereby to yield a list of sequential musical tones that relates to the melody that the human ear perceives, and the instants when each tone was perceived.

Melody detection should not be confused with music annotation. As the two are fundamentally different. Performing music annotation is trying to trace all the notes actually played by a specific instrument in order to reconstruct the original music sheet, whether consisting of a single note as for a trumpet, or multiple notes as for a piano hitting multiple keys at the same time. Performing melody detection is trying to interpret the global perceptual effect of all the sounds at once, to determine what is the melody actually perceived by the human ear, rather than the notes actually played by each instrument, and provide a music sheet including a time sequence of single notes describing that melody.

In one aspect the invention relates to a method for performing melody detection by interpreting the global perceptual effect of all the sounds at once, to determine what is the melody actually perceived by the human ear, and providing a music sheet or a text printout including a time sequence of single notes describing that melody.

According to one embodiment of the invention the method comprises the steps of:

(I) Performing the simultaneous least-squares optimal detection of the frequency and the amplitude of all the sinusoidal components present at a given instant in the global composite sound.

(II) Computing the total perceptual power by summing up the perceptual power of all the sinusoidal components detected.

(III) Keeping only the incremental power of the tones the amplitude of which is growing with time, and discarding tones the amplitude of which is steady or decaying in time.

(IV) Performing the following sub-steps:

(a) Determining the fundamental frequency and the perceptual power of all the possible Fourier series arising from all the possible combinations of the sinusoidal components determined in (III) above, possibly sharing common harmonics;

(b) Locating the Fourier series of largest perceptual power, and setting its perceptual power as the peak perceptual power; and (c) If the peak perceptual power is below some predefined melody threshold, then going back to step (I).

(V) Computing the background perceptual power present in the Fourier series relative to peak perceptual power.

(VI) Denoting by Fourier series of comparable power all the Fourier series among those determined in (IV), the perceptual power of which is greater than the peak perceptual power minus the background perceptual power.

(VII) Taking the Fourier series of comparable power having the highest fundamental frequency as the dominant Fourier series, and taking the corresponding instant as the time of occurrence of the tone; and (VIII) Optionally, performing chord detection.

(IX) Optionally keeping the non-incremental power instead of the incremental power when the melody to be detected is generated by nearly steady or prolonged sounds.

According to one embodiment of the invention step (I) is carried out about 15 times every second, using a novel set of multiple bases, each built so to separately fulfill the requirements of Heisenberg's uncertainty principle, thereby to allow detecting each frequency component in the shortest possible time, and where different sets of "mistuned" multiple bases may be used to accommodate mistuned instruments or voices.

According to another embodiment of the invention the method of step (II) further comprises setting a melody threshold as a given percent of the total perceptual power, or a correct detection probability threshold (directly derived from said melody threshold) thereby allowing to detect the presence of melody above a strong background. The melody threshold can be set in a broad range, e.g., in the 10%±50% range.

In yet another embodiment of the invention in the method of step (III) the difference between the power of each frequency component in the optimal detection, and the power of the same frequency component found in a previous optimal detection are computed and, if the difference is positive this difference is assigned as the differential power of the sinusoidal component at the given frequency; otherwise, the differential power is set to zero.

In still another embodiment of the invention the method according to step (VIII) comprises detecting a chord by looking at all the groups of at least three simultaneous long-lasting groups of tones having mutually different fundamental frequency and finding the dominant chord by summing up the perceptual power of all the dyadic tones related to each group, and selecting the group that has the largest total perceptual power.

The invention is further directed to a N by N selection matrix, which when multiplied by the vector of the power values of the N frequencies components found with the least-square process selects all the possible Fourier series and generates a vector of N component values, where the value of the nth component corresponds to the cumulative power of the Fourier series the fundamental frequency of which corresponds to the nth key.

The number of rows and columns in the N by N selection matrix may vary and according to one embodiment of the invention the selection matrix is a 60 by 60 matrix, comprising a first line consisting of 60 values which are all zeros except the first, $13^{th}$, $20^{th}$ and the $25^{th}$ values which are 1, and wherein line number n is identical to the first line but with the 1 values shifted to the right by n places, and wherein if a 1 is shifted beyond place 60 is discarded.

According to the invention different octaves can be used to performing the melody detection (also referred to herein as "interpretation"), and according to one embodiment of the invention the interpretation is carried out using all the octaves of a standard piano keyboard. According to another embodiment of the invention the interpretation is carried out using only part of the octaves of a standard piano keyboard. According to still another embodiment of the invention the interpretation is carried out using the four and a half octaves starting at the third octave of a standard piano keyboard.

Also encompassed by the invention is a device for performing melody detection, comprising a CPU and memory means associated with said CPU, which memory means contain information about the fundamental frequencies of all or of part of the keys of a standard piano keyboard. According to one embodiment of the invention the device of the invention is adapted to analyze a streaming audio in blocks of 1104 samples and to compare it with the third octave of a standard piano keyboard, at a sampling rate resulting in a sampling time of about 128 milliseconds per block or longer. In one embodiment of the invention the sampling time is about 138 milliseconds per block.

According to another embodiment of the invention the memory location stores samples of signals at fundamental frequencies of each of 12 keys of an octave. In one mode of operation a first set of memory locations refers to the DO3, a second set refers to DO #3, and a third set refers to RE3, and so on.

In one implementation of the invention each set of memory locations contains two vectors of values, one containing samples of a sine function at the frequency corresponding to the first key, and the second containing samples of a cosine function at the frequency corresponding to said first key. For instance, each of said vectors of values may consist of 1104 samples that have been computed beforehand.

The device of the invention is adapted, according to one embodiment, to analyze a streaming audio in blocks of 1104 samples and to compare it with the fourth octave of a standard piano keyboard, at a sampling rate resulting in a processing time of about 64 milliseconds per block or longer. In another embodiment of the invention the device of the invention is adapted to analyze a streaming audio in blocks of 1104 samples and to compare it with the fifth octave of a standard piano keyboard, at a sampling rate resulting in a processing time of about 32 milliseconds per block or longer. In yet another embodiment of the invention the device of the invention is adapted to analyze a streaming audio in blocks of 1104 samples and to compare it with the sixth octave of a standard piano keyboard, at a sampling rate resulting in a processing time of about 16 milliseconds per block or longer. According to yet another embodiment of the invention the device of the invention is adapted to analyze a streaming audio in blocks of 1104 samples and to compare it with the seventh octave of a standard piano keyboard, at a sampling rate resulting in a processing time of about 8 milliseconds per block or longer.

In one embodiment, the device of the invention comprises computation circuits adapted to analyze a matrix containing a random mix of frequencies pertaining to all the keys of all the octaves, at the same time by comparison with the prestored vectors of values, by carrying out a least-square analysis to find which combination of stored vectors at optimal amplitudes best describes the sampled data.

Other characteristics and advantages of the invention will become apparent as the description proceeds.

BRIEF DESCRIPTION OF THE DRAWINGS

In the drawings:

FIG. 8 schematically shows a selection matrix used for locating the dominant Fourier series according to one embodiment of the invention.

DETAILED DESCRIPTION OF THE INVENTION

While a detailed description of all steps will be provided hereinafter, including the full mathematical processing, it will be useful for the sake of understanding to describe first the invention in respect of its main building blocks. In the basic description below the process exemplified will make use of the four and a half octaves illustrated in FIG. 2, although it is of course possible to make use of the full keyboard. However, for practical purposes operating as described herein is sufficient to obtain the results of the invention while maintaining a low processing power demand.

In order to perform the invention the memory means associated with the CPU must contain information about the fundamental frequencies of all the keys referred to above, as explained in further detail with reference to FIG. 7. In the figure, SA indicates the streaming audio containing the melody to be analyzed. In the illustrative embodiment the streaming audio is analyzed in blocks of 1104 samples, at a sampling rate of 8000 samples/second, which results in a sampling time of 138 milliseconds per block.

Figure 7:
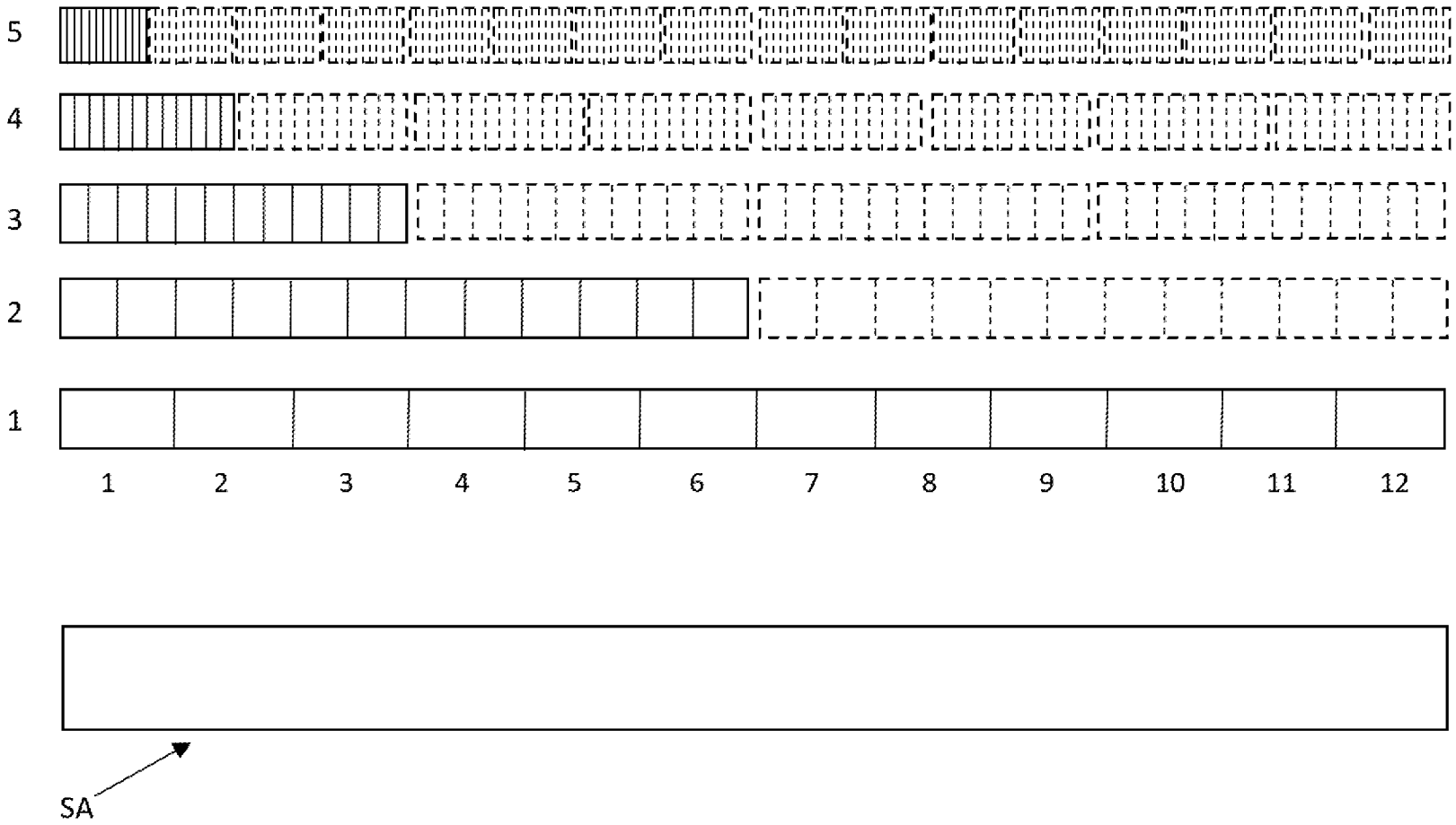
FIG. 7 schematically shows the memory allocation of the information required for carrying out the invention according to a minimal processing power requirement embodiment.

FIG. 7 shows the memory locations storing samples of signals at fundamental frequencies of each of 12 keys of an octave. The line numbered 1 indicates the memory locations for the first octave, which is Octave 3 of FIG. 2. Correspondingly, lines 2 through 5 indicate the memory locations in respect of Octaves 4 through 7 of FIG. 2.

As seen, line 1 consists of data pertaining to the 12 keys of the first octave, where set 1 of memory locations refers to the DO3, set 2 refers to DO #3, set 3 refers to RE3, and so on. Each set of memory locations contains two vectors of values, one containing samples of a sine function at the frequency corresponding to Key 1, and the second containing samples of a cosine function at the frequency corresponding to Key 1. Each of said vectors of values consists of 1104 samples. These values have been computed beforehand and are used according to the invention to carry out computations with streaming sampled data, as will be further explained hereinafter. Precomputed values are also contained in the remaining 11 memory sets of line 1.

The length of 138 milliseconds of each memory set of line 1 is dictated by the need to discriminate between the frequencies of two adjacent keys, because the frequency spacing of two adjacent keys is about 5.95% of the lower frequency key. So, for example, in the case of DO3 (key 1) the frequency is about 130.81 Hz, and for DO #3, the frequency is about 138.59 Hz, so the difference is 7.78 Hz. The time required for recognizing one cycle of the frequency difference is about 1/7.78 seconds=0.128 seconds, thus in order to ensure proper recognition in this illustrative process a time of 0.138 has been selected, corresponding to 1104 samples.

The same DO in the higher octave, DO4, has a frequency twice as high as that of DO3, namely 261.62 Hz. Therefore the difference in frequency between the two adjacent keys DO4 and DO #4 is 15.56 Hz and therefore the time required for recognizing one cycle of the frequency difference (to discriminate between two adjacent keys) is about 1/15.56 seconds=0.064 seconds, and therefore each vector of values in this octave consists of 1104/2=552 samples, and for each subsequent increase in octave, the number of samples in each vector of values is reduced by a factor of two. Thus, during the time needed for detecting one key of the first octave, one may simultaneously detect two subsequent keys of the second octave, four subsequent keys of the third octave, eight subsequent keys of the fourth octave, and sixteen subsequent keys of the fifth octave. This is shown in FIG. 7 by the sets in broken lines.

Looking now at SA, which may contain a random mix of frequencies pertaining to all the keys of all the octaves, as will be apparent from the above description, the same sampled data are analyzed at the same time by comparison with the prestored vectors described above. The "comparison" is performed by carrying out a least-squares analysis to find which combination of stored vectors at optimal amplitudes best describes the sampled data. The least-squares method is well known to the skilled person and therefore is not further described herein, for the sake of brevity.

Once the above determination is completed, there is a need to identify the sub-set of detected vectors and amplitudes that best fits the melody note heard by our perception.

This requires finding among the vectors identified by the above process the one combination that defines the dominant Fourier series among the many possible Fourier series that can be constructed using all the different combinations of vectors and amplitudes detected. For all practical purposes it has been found that it is sufficient to consider only the set of the first 3 or 4 harmonics of each candidate Fourier series, as it usually contains more than 90% of the total power of the series. For this purpose, the invention provides a novel selection matrix, as illustrated with reference to FIG. 8.

The method of the invention comprises the following steps:

(I) Performing the simultaneous optimal (least-squares) detection of the frequency and the amplitude of all the sinusoidal components (the harmonics) present at a given instant in the global composite sound. In one embodiment of the invention this action is carried out about 15 times every second, using a novel set of multiple vector bases, each built so to separately fulfill the requirements of Heisenberg's uncertainty principle, thereby to allow detecting each frequency component in the shortest possible time.

(II) Computing the total perceptual power by summing up the perceptual power of all the sinusoidal components detected, and setting a melody threshold MT as a given percent of the total perceptual power which allows to detect the presence of a melody provided that its power is at least MT % of the total perceptual power. If the perceptual power concentrated within the dominant Fourier series is below said melody threshold, then according to this specific embodiment of the invention it is discarded "detecting no melody" at the given instant. In one embodiment of the invention the melody threshold is set in the 10%-50% range.

While no human intervention is required for carrying out the invention, the result can be improved by the operation of a human operator, who may further improve the results obtained by reaching an optimal threshold. The process of setting the optimal threshold includes a mutual human-machine interaction, where the human hearing and the subjective perception play a significant role in optimally discriminating between accompaniment and melody.

(III) Keeping only the incremental power of these harmonics, the amplitude of which is growing with time, and discarding harmonics the amplitude of which is steady or decaying in time. This step is essential in determining the newly generated Fourier series, thus properly discriminating between harmonics belonging to melody (which consists of tones building up and thus rising up in power) and strong steady accompaniment (tones of nearly constant power) or prolonged echo from previous tones (tones decaying in power).

In order to accomplish this result, in an embodiment of the invention the difference between the power of each harmonic frequency component just found in the present optimal detection, and the power of the same harmonic frequency component found in the previous optimal detection is computed. In said specific embodiment of the invention, if the difference is positive this difference is assigned as the differential power of the sinusoidal harmonic component at the given frequency; otherwise, the differential power is set to zero. This action is skipped for chord detection which uses a modified algorithm, since, as opposed to melody, chords consist of long-lasting/slowly decaying groups of harmonics (see VIII below), and may also be skipped when detecting a melody consisting of steady or prolonged sounds generated by a single source such as in the case of a voice solfege.

(IV) (a) Determining the fundamental frequency and the perceptual power of all the possible Fourier series arising from all the possible combinations of the incremental sinusoidal harmonic components determined in (III) above. It should be noted that different potentially dominant Fourier series may be constructed by combinations sharing common harmonics. For instance one series may consist of incremental harmonics at frequencies 750, 1500 and 2250 Hz (fundamental, second and third harmonic) and the other may consist of incremental harmonics at frequencies 500, 1500 and 2000 Hz (fundamental. third and fourth harmonic), where the harmonic component at 1500 Hz is the very same sinusoidal component in both, but the dominant tone actually perceived may be either 750 Hz or 500 Hz depending on what series has largest total perceptual power.

If the melody is located within a known range of frequencies, for instance, when looking to detect the melody sung by a female soprano singer, whose fundamental voice frequency range is typically 261 Hz to 1044 Hz (C4-C6, about two octaves), all possible Fourier series with fundamental frequency outside of said range may be discarded a-priori, thus making it possible to prevent erroneous melody detection due to strong accompaniment peaks.

(b) Locating the Fourier series of largest perceptual power, and setting its perceptual power as the peak perceptual power; and (c) If the peak perceptual power is below the melody threshold, then going back to step (I).

(V) Computing the estimated background perceptual power (the "noise" power) present in the Fourier series relative to peak perceptual power.

(VI) Denoting by Fourier series of comparable power all the Fourier series among those determined in (IV), the perceptual power of which is greater than the peak perceptual power minus the estimated background perceptual power.

(VII) Taking the Fourier series of comparable power having the highest fundamental frequency as the dominant Fourier series, and taking the corresponding instant as the time of occurrence of the tone.

Step (VII) is based on the inventor's observation that we tend to identify the melody with the higher-frequency tones.

(VIII) Optionally, performing chord detection.

As opposed to melody that may change rapidly, a chord is detected by looking at all the groups of at least three simultaneous long-lasting groups of tones each carrying a substantial portion of the total perceptual power and having mutually different fundamental frequency. Long lasting tones are the tones repeatedly detected in step (I). The dominant chord is found by summing up the perceptual power of the fundamental tone and of all the dyadic tones related to each group, and selecting the group that has the largest total perceptual power. For each fundamental frequency $f_0$ within such a group, the related dyadic tones are all the tones that satisfy $f_n=2^n f_0$, n=1, 2, 3, . . . . A dominant chord is valid provided that it satisfies certain conditions specified hereinafter, and related to relative perceptual power and to relative fundamental frequency within the dominant chord. Chord detection is done in parallel to melody detection, but with a much simpler and independent process.

Detailed Description of Illustrative Embodiment

The invention will now be illustrated with reference to a specific illustrative embodiment, by putting the frequencies of the sinusoidal components in correspondence with the fundamental frequency of piano keys. For the sake of simplicity, the musical instrument of this illustrative and non-limitative example is the piano, it being understood that the very same description applies to any other musical instrument and to other examples.

Spectral Architecture of Musical Sound

The fundamental frequency $f_{key\ \#}$ of each of the keys of a piano, is given by $$f_{key\#} = 2^{\frac{key\#-49}{12}} \times 440 \text{ Hz} \tag{1}$$

Figure 1:
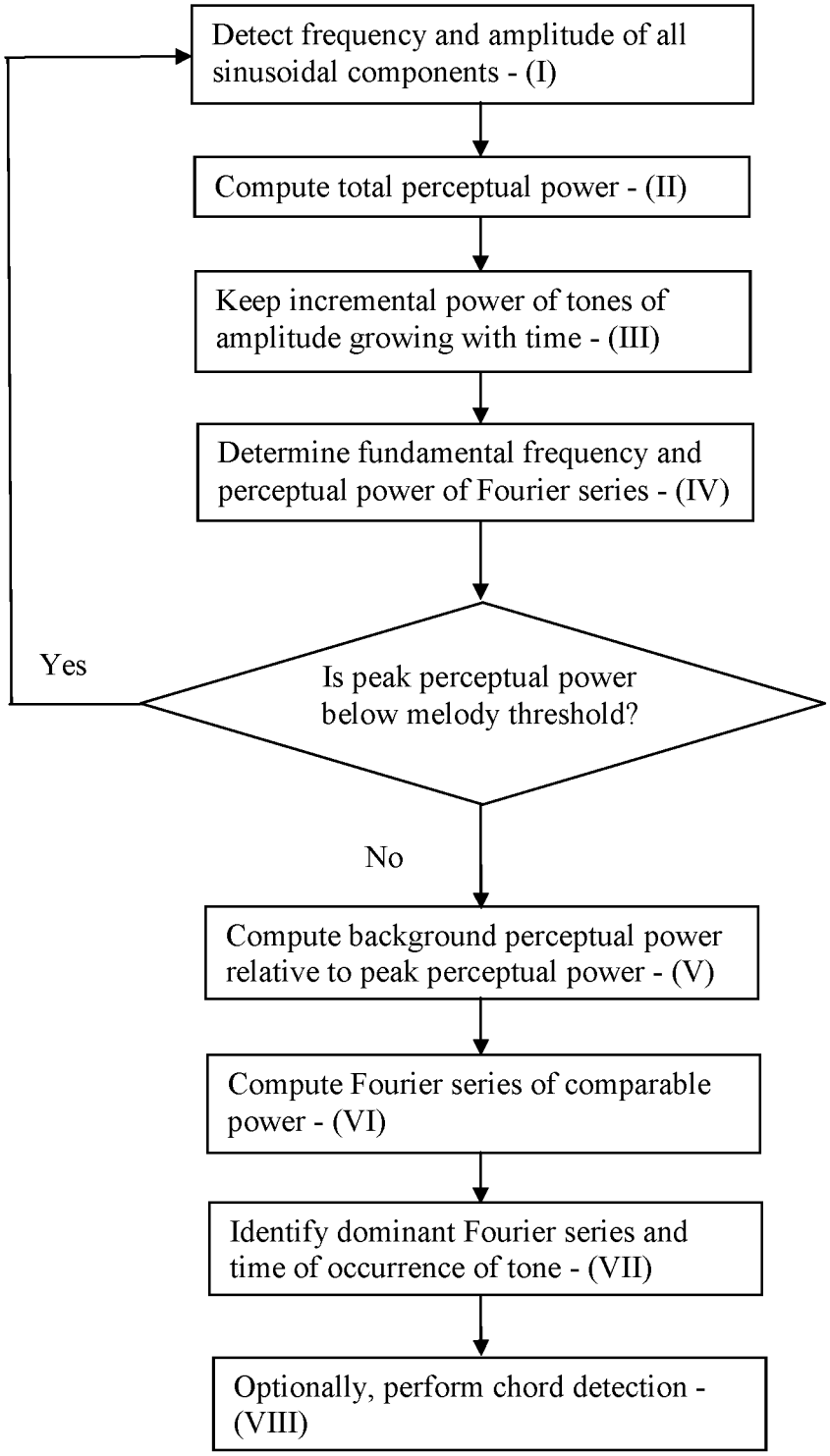
FIG. 1 is a schematic flow chart of the process, according to one embodiment of the invention.
Figure 2:
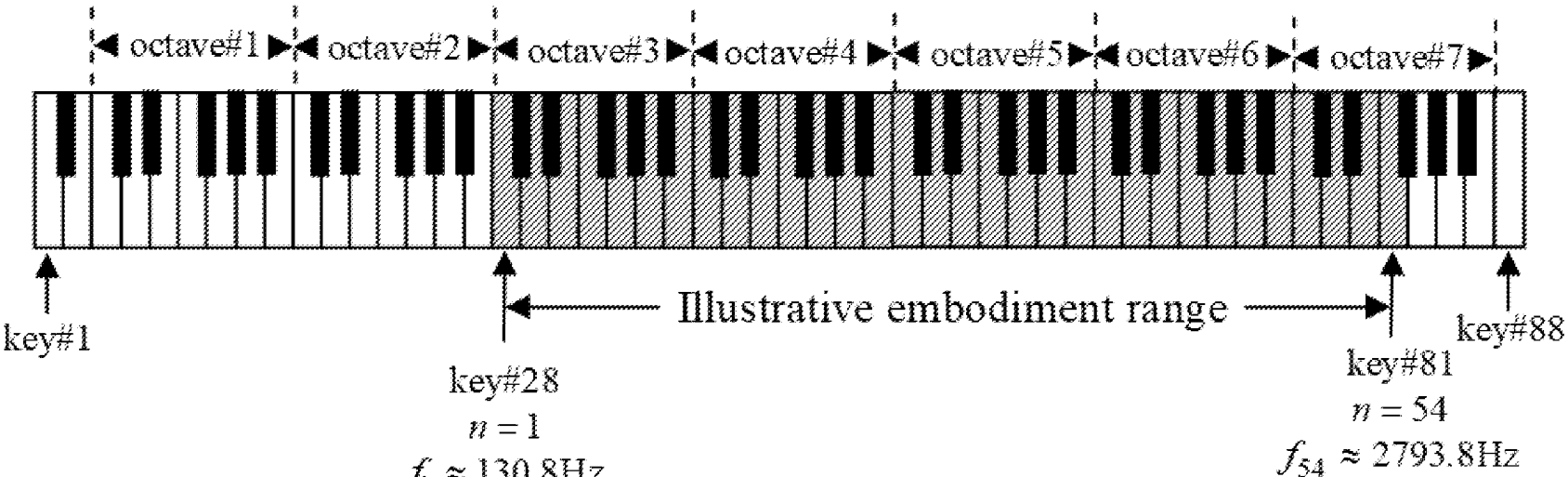
FIG. 2 shows piano keys indexing of an illustrative example of execution of the invention.

The illustrative example, as shown in FIG. 2, covers 54 piano keys, from key #28, named C3 (C of the 3rd octave), to key #81, named F7 (F of the $7^{th}$ octave) namely, about 4.5 octaves. This range was found satisfactory because:

- It is sufficient to cover virtually all the practical scenarios for the purpose of melody detection.
- The whole range may be processed with satisfactory spectral guard-band at 8000 samples/second, which is the lowest sampling rate available in ".wav" format.
- The process runs effectively with input data in 8000 Hz/8 bit or 16 bit-PCM .wav format, which requires low computational power and makes it well fit for running on any smartphone.

FIG. 2 shows the key # range for this example, as well as the corresponding fundamental frequencies. In all that follows, reference is made to the relevant piano keys in the example's range, by indexing them from n=1 to n=54. With this notation, the fundamental frequencies of the piano keys are exactly given by $$\begin{aligned} f_n &= 110 \times 2^{\frac{n+2}{12}} \text{ Hz} = 123.47 \times 2^{n/12} \text{ Hz}, \\ key\# &= 28 + n - 1, \\ n &= 1, 2, \ldots, 54, \end{aligned} \tag{2}$$

Thus, for every 12 keys "jump" the fundamental key frequency is doubled. Doubling the frequency is denoted as increasing it by an octave. Equation (2) implies that the frequency difference between any two adjacent keys is $$\Delta f_n = f_{n+1} - f_n = \left(2^{\frac{1}{12}} - 1\right) f_n \approx 0.0595 f_n \Rightarrow \begin{cases} \Delta f_1 \approx 7.79 \text{ Hz} \\ \Delta f_{53} \approx 157 \text{ Hz} \end{cases} \tag{3}$$

By Heisenberg's uncertainty principle, the minimal period of time $\Delta T_n$ required to distinguish between two keys with frequency separation $\Delta f_n$ is of the order of magnitude of the inverse of the frequency separation, namely $$\Delta T_n \approx \frac{1}{\Delta f_n} \Rightarrow \begin{cases} \Delta T_1 \approx 1/\Delta f_1 \approx 128 \text{ msec} \\ \Delta T_{53} \approx 1/\Delta f_{53} \approx 6.37 \text{ msec} \end{cases} \tag{4}$$

Since we don't know a-priori whether or not adjacent tones will be present, the processing time for the detection of each key must be set at least to the length defined by (4) for the relevant index n. Therefore, during the time period needed to detect one bass sound, several different treble sounds may show-up, and the process must be able to simultaneously detect all of them. In the following, we denote by T the frame time, namely, the processing time required to detect the lowest-frequency component at frequency $f_1$. In the present example we set $$\begin{aligned} &T=138 \text{ msec}, f_s=8000 \text{ samples/sec}, t_s=1/f_s=125\ \mu\text{s}, \\ &S=T\times f_s=1104 \text{ samples} \end{aligned} \tag{5}$$

where T is the frame time, $f_s$ is the sampling rate, and S is the frame size in samples.

Optimal Detection of the Sinusoidal Components

As stated, the first task should be carried out is the simultaneous optimal detection of the frequency and the amplitude of all the sinusoidal components occurring in the global composite sound during the frame time T. In the current art, such type of detection is often done by computing a fast Fourier transform (FFT) of the corresponding S samples in T, and looking for the absolute value of the FFT components. Alternatively, a wavelet transform is used looking for the absolute value of the wavelet coefficients. However, these approaches are not optimal, because they disregard the phase information. Although the human ear is not sensitive to phase, the phase information is useful in finding an optimal detection, and reducing the errors that occur due to the artifacts showing up between adjacent frames.

Figure 3:
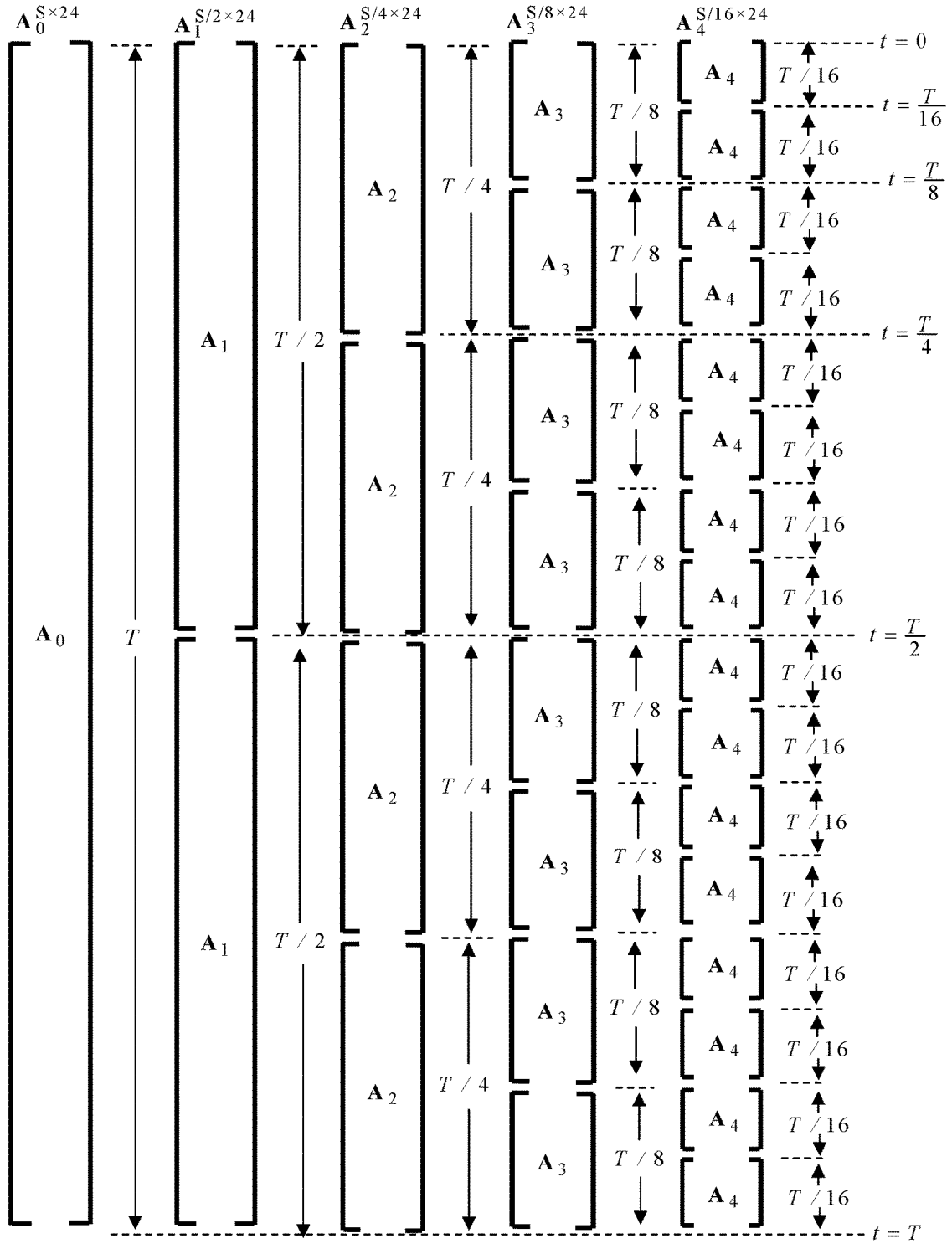
FIG. 3 is a graphic illustration of the process of detection of the sinusoidal components according to one illustrative embodiment of the invention.

FIG. 3 is useful to illustrate the following stage, as will become apparent from the description to follow. With reference to FIGS. 2 and 3, we proceed as follows: At each octave level in FIG. 2 (octave #3 through octave #7) we construct a non-orthogonal vector basis for the 12 fundamental sinusoidal components within that octave. The basis for each octave includes vectors of samples of cosine functions and sine functions at the fundamental frequencies of each of the 12 keys in that octave, so to allow for including both arbitrary amplitude and phase. The basis constitute the 24 columns of a matrix $A_m$ for m=octave #−3={0, 1, 2, 3, 4}. The number of rows of $A_m$ has at least the dimension required to satisfy Heisenberg's principle for the lowest frequency in each octave. Thus, during the detection of a lower-frequency components, several higher-frequency components may be simultaneously detected. Heisenberg uncertainty principle applied to time signals implies that in order to discriminate and detect two frequencies f1 and f2, one needs a time period of the order of T=1/|f1−f2|. It follows that, in our context, higher frequencies can be detected faster than lower ones. (Reference: Mallat S. "A wavelet tour of signal processing" Academic Press, 1999. Pp. 30-32). All the columns of all the matrices $A_m$ are normalized so to have 2-norm equal unity. In other words, all the vectors belonging to the basis so normalized, have unit power. In each of the matrices $A_m$ of the present example there are $1104/2^m$ rows and 24 columns. It follows that the key detection time is reduced by a factor of two for every increase in octave.

From equation (5) it follows that the processing time required for the detection of each key in octave #3 is 1104×125 μsec=138 msec and all the 1104 samples of the global sample set taken over the time frame must be used, while in octave #7 the key detection time is only $1104/2^4\times$ 125 μsec=8.625 msec and can be carried on using any subset of consecutive samples of size $1104/2^4=69$ from the same global sample set of size S=1104. Thus we are able to detect simultaneously several keys at different octaves within one time frame. The process is pictorially shown in FIG. 3. The details how to build the matrices $A_m$, m=0, 1, 2, 3, 4, will be provided later in this description. The construction of the matrices $A_m$ bears unique properties, as described hereinafter.

For the purpose of illustration, let us denote by $A_m^t$ the transpose of the matrix $A_m$, and define the 24×24 matrix $B_m$ as $$B_m^{24\times 24}=A_m^t A_m \tag{6}$$

The $B_m$ matrices so constructed are Hermitian, thus their eigenvalues are also their singular values, and a straightforward computation shows that for all m, they have almost identical maximal and minimal positive (nonzero) eigenvalues (EV). Moreover, the maximal and minimal eigenvalues of each of the matrices $B_m$, are close enough in value so that their condition number $K_B$ is small, namely $$\max\{EV\}\approx 1.54,\ \min\{EV\}\approx 0.62 \Rightarrow K_B=\frac{\max\{EV\}}{\min\{EV\}}\approx 2.5 \tag{7}$$

Equation (7) implies that all the matrices $B_m$, m=0, 1, 2, 3, 4 are non-singular. The fact that $B_m$ is non-singular, guarantees that, given a vector $y_m$ consisting of any subset of $S_m=1104/2^m$ adjacent samples taken from the global sample set of S=1104 samples in the time frame T, there exists a vector $x_m$ of dimension 24, consisting of a set of 24 optimal coefficients, such that the vector $z_m=A_m x_m$ in (8) provides the best possible approximation to the set of samples $y_m$, that one can build using only a combination of the columns of $A_m$ whose elements consist of samples of components at fundamental frequencies belonging to octave #(m+3). In other words, the 2-norm of the error, $\|z_m-y_m\|_2$, is a measure of how "close" $z_m$ is to the samples $y_m$ of a sound belonging to the octave #(m+3).

The approximation is optimal in the least-squares (LS) sense, meaning that the energy of the error $\|z_m-y_m\|_2^2$ is minimal. Since the columns of $A_m$ are normalized to unit 2-norm, the more the samples in $y_m$ resemble the samples of a single frequency components in octave #(m+3), the closer $\|x_m\|_2$ gets to $\|y_m\|_2$.

$$\underbrace{\begin{bmatrix} y_1\\ y_2\\ y_3\\ \vdots\\ y_{S/2^m}\end{bmatrix}}_{y_m} \simeq \underbrace{\begin{bmatrix} z_1\\ z_2\\ z_3\\ \vdots\\ z_{S/2^m}\end{bmatrix}}_{z_m} = \underbrace{\begin{bmatrix} a_{1,1} & a_{1,2} & \cdots & a_{1,24}\\ a_{1,2} & a_{2,2} & \cdots & a_{2,24}\\ a_{1,3} & a_{3,2} & \cdots & a_{3,24}\\ \vdots & \vdots & \vdots & \vdots\\ a_{S/2^m,1} & a_{S/2^m,2} & \cdots & a_{S/2^m,24}\end{bmatrix}}_{A_m} \underbrace{\begin{bmatrix} x_1\\ x_2\\ \vdots\\ x_{24}\end{bmatrix}}_{x_m} \tag{8}$$

For each m, the vector $x_m$ is found by performing a numerical computation known as the QR decomposition of the matrix $A_m$. The success in finding $x_m$ is guaranteed since $B_m$ is non-singular. The QR decomposition is a standard operation in numerical algebra, may be performed using different algorithms, and we don't discuss it here. In the illustrative embodiment, the QR decomposition is carried out using a standard algorithm known as the Modified Gram-Schmidt Algorithm.

The small value of the condition number in equation (7), implies that all the matrices $B_m$ are well-conditioned, which in turn implies that the computation of $x_m$ is numerically stable, namely, when computing the vectors $x_m$ the numerical error is well-bounded, and the solution is reliable.

Moreover, a straightforward computation shows that whenever a vector of dimension equal to the number of the rows of the matrix $A_m$ consists of combinations of samples of harmonic components belonging to an octave other than octave #(m+3), the columns of the matrix $A_m$ are quasi-orthogonal to that vector, where quasi-orthogonal means that the inner product of said vector with any column of $A_m$, yields a value much smaller than unity (of the order of less than 0.1). This property greatly reduces the probability of detecting artifacts.

Upon completing the computation of $x_m$, m=0, 1, 2, 3, 4 we are left with five vectors $x_0$, $x_1$, $x_2$, $x_3$, $x_4$, each of them of dimension 24, where $$x_m=[x_1^{[m]},x_2^{[m]},\ \ldots\ ,x_{2i-1}^{[m]},x_{2i}^{[m]},\ \ldots\ ,x_{23}^{[m]},x_{24}^{[m]}],\ m=0,1,2,3,4$$

Due to the architecture of the matrices $A_m$, where the normalized odd columns consist of samples of cosine functions, and the normalized even columns consist of samples of sine functions, $x_m$ yields an optimal estimate of the power $p_i^{[m]}$, i=1, 2, . . . , 12 of each of the 12 sinusoidal components present at each octave #(m+3) within the global composite sound, in the form $$p_i^{[m]}=2^m\left[(x_{2i-1}^{[m]})^2+(x_{2i}^{[m]})^2\right],\ i=1,2,\ldots,12,\quad m=0,1,2,3,4 \tag{10}$$

Due to Heisenberg's principle which dictated the hierarchical architecture of the matrices $A_m$ in FIG. 2, in the time required to detect a lower-octave component, we may detect several higher-octave components. In the illustrative example provided herein, as pointed out before, (5) implies that during each frame time of 138 msec we may detect up to 16 components at the top-octave level, each within 138/16=8.625 msec. This implies that every 8.625 msec we have an optimal estimate of all the component powers $p_i^{[m]}$ in (10). However, in practice, such a time resolution is not needed, since the shortest melody tones last for 70÷100 msec at least. Moreover, there is no reason to assume that a tone begins or ends exactly at the beginning of at the end of a time frame, as its onset or decay may occur anywhere within the frame. Thus, in the illustrative example, for any fixed indexes i and m, we average the values of all the sequentially detected $p_i^{[m]}$ over the entire frame length, and we keep this average value as $\overline{p}_i^{[m]}$. Then, instead of taking the next sample set by shifting the data by a full frame forward (1104 samples forward), we shift only half-frame and re-compute the optimal estimation (smaller shifts up to 1/16 of a frame are also possible). Doing so we achieve a time resolution of 138/2=69 msec, while we are still able to detect the components at the lowest octave, since the frame always remains of full length. Moreover, we introduce some data commonality between subsequent frames, thus reducing artifacts due to disjoint data support. For the reasons pointed out before, we also keep all the values computed in a previous estimation as $\overline{p}_i^{[m]}|_{old}$.

Computing the Differential Power

The sinusoidal components in the global composite sound, whether musical or vocal, are all generated by physical processes that can build up in a very short time, but often decay very slowly, whether because of natural slow decay as in a guitar string, or because of echo/reverberant effects. Moreover, a piece of music may comprise a strong steady accompaniment, such as the sound of an organ or a violin. These long-lasting sounds may have power comparable or even greater than the sound related to melody, and may mask it during the detection process described hereinabove. However these long-lasting sinusoidal components have all the characteristic that their power is either steady or decaying, while a newly-generated sinusoidal component suddenly shows-up from zero power level to a considerable power level in a very short while. A typical example is the impulse response showing up almost instantaneously when one hits a piano string. Even if the newly-generated component has the same frequency of an existing steady component previously generated by some instrument, the power detected at the given frequency will exhibit a sudden power jump. Therefore, in order to discriminate between melody and strong steady accompaniment or prolonged echo form previous tones, we retain only the positive differential power, namely, we continuously compute the difference between the power of each frequency component just found in the present optimal detection $\overline{p}_i^{[m]}$, and the power of the same frequency component found in a previous optimal detection $\overline{p}_i^{[m]}|_{old}$. If the difference is positive we assign this difference as the differential power $\Delta\overline{p}_i^{[m]}$ of the sinusoidal component at the given frequency, else we set the power to zero $$\Delta\overline{p}_i^{[m]} = \begin{cases} \overline{p}_i^{[m]} - \overline{p}_i^{[m]}|_{old}, & \overline{p}_i^{[m]} > \overline{p}_i^{[m]}|_{old} \\ 0, & \overline{p}_i^{[m]} \le \overline{p}_i^{[m]}|_{old} \end{cases} \tag{11}$$

Doing so we keep only the newly-generated components. Optionally, in the case where the melody to be detected derives from nearly steady sounds only, such as the sound of an organ, or a steady prolonged singing human voice, $\Delta\overline{p}_i^{[m]}$ may be replaced by $\overline{p}_i^{[m]}$.

Computing the Differential Perceptual Power and the Total Perceptual Power

From now on, unless otherwise stated, when talking about "power" we always implicitly mean "differential power". Equation (11) yields the estimate of the physical power of all the sinusoidal components at all the five octaves in the illustrative example (octave #(m+3), m=0, 1, 2, 3, 4) where for each octave we estimated the power of the 12 sinusoidal sound components belonging to that octave. Altogether we found the estimated power of all the 12×5=60 sinusoidal components within the global composite sound, where the components with index i=55 through i=60 are set to zero because they are very close to the Nyquist bound of the sampling rate, and cannot be relied upon.

In order to compute the perceptual power, we must multiply each value of $\Delta\overline{p}_i^{[m]}$ in (11) by the corresponding value taken from the equal loudness contour. The contour is a statistical weighting function which is somewhat dependent on the sound intensity. For the illustrative example we picked up sample weights in a medium-level contour, and we generated the interim values by piecewise polynomial interpolation. The contour weights $w_i^{[m]}$ and the resulting weight function are given hereinafter with reference to FIG. 5. Optionally other weighting functions (or a flat one), may be used in specific settings.

We multiply each $\Delta\overline{p}_i^{[m]}$ and each $\overline{p}_i^{[m]}$ value by the corresponding weight $w_i^{[m]}$, and compute the resulting (differential) perceptual power coefficients $wp_i^{[m]}$ and the absolute (non-differential) perceptual power coefficients $wabsp_i^{[m]}$ for each sinusoidal component estimate, in the form $$\begin{cases} wp_i^{[m]} = w_i^{[m]}\Delta\overline{p}_i^{[m]} \\ wabsp_i^{[m]} = w_i^{[m]}\overline{p}_i^{[m]} \end{cases}, \; i = 1, 2, \ldots, 12, \; m = 0, 1, 2, 3, 4 \tag{12}$$

Using the perceptual power coefficients $wp_i^{[m]}$ we build a perceptual power vector pv of dimension 60 as follows $$pv^{60\times 1}=[pv_1, pv_2, \ldots, pv_{60}]^t, pv_{i+12m}=wp_i^{[m]}, \; i=1, 2, \ldots, 12, \; m=0,1,2,3,4 \tag{13}$$

Where the superscript $[\bullet]^t$ indicates transpose. Thus pv comprises the estimated perceptual powers of all the fundamental sinusoidal tones in the illustrative example ordered from the lowest piano key # to the highest piano key #. Summing up all the components $wabsp_i^{[m]}$ in (12) we compute the total absolute perceptual power Pt, which is used in the illustrative example together with the melody threshold mentioned hereinbefore. A pictorial description of the architecture of pv is given in FIG. 4.

The perceptual vector pv consists of the optimal estimate of the perceptual power of each of the sinusoidal components at octave #(m+3) in the global sound. However, once pv has been determined, there is still a critical task left, namely, find out the dominant Fourier series.

Determining the Candidate Fourier Series

From (2) we note that for all n=1, 2, 3, . . . we get $$f_{n+k}=123.47\times 2^{(n+k)/12}=2^{k/12}f_n \tag{14}$$

It turns out that all the relevant harmonic frequencies potentially discoverable with the given sampling rate, fall at or very close to one of fundamental frequencies of the keys indexed 1 through 54. As we see shortly, this fact is of major impact and extremely useful when trying to determine the fundamental frequency and the perceptual power of all the possible Fourier series sharing common harmonics, arising from all the possible combinations of the sinusoidal components, as pointed out above.

For instance, according to (14), $f_{n+19}=2^{19/12}f_n=2.9966f_n\approx 3f_n$. According to Heisenberg's uncertainty principle, the frequencies $2^{19/12}f_n$ and $3f_n$ are much too close to be distinguished in the time required for the detection of the note. Therefore, when we try to detect whether the key with index n=22 has been hit, we cannot determine if the power we detect at frequency $f_{22}$ belongs to the fundamental of the key with index n=22, or is due to the third harmonic of the key with n=3, or even a combination of the two. However, as pointed out before, as opposed to music annotation, when looking for melody detection, we don't care what key has been hit, and we are concerned only with finding the fundamental frequency of the Fourier series with the strongest perceptual power.

Based on our observation, in practical cases, more than 90% of the perceptual power of the dominant Fourier series resides within the first three (3) harmonics for instrumental sounds, and within the first six (6) harmonics for vocal sounds, including fundamental. Moreover, as pointed out in the background section, the fundamental frequency of low-frequency Fourier series may be missing. Therefore the knowledge of at least three harmonic components is required to guarantee the proper detection of the fundamental frequency of a Fourier series. Thus in the illustrative example we assumed as a default, that all the Fourier series include at most the first three components, which we denote as a "H3 series" and left the option to include up to the first six components ("H6 series").

For h=0, 1, 2, 3, 4, 5, for any k that satisfies $2^{k/12}\approx h$, the fundamental piano key frequency $f_{n+k}$ in (14), is close to the frequency of one of the first six harmonic frequencies of the piano key with index n. Let us write down a table of $2^{k/12}$ for $2^{k/12}\approx h$, and compare it with the closest integer. The result is shown in Table 1, where "error" indicates the error with respect to the integer value.

TABLE 1 location of harmonic frequencies in correspondence to piano key index shift

| h | 0 | 1 | 2 | 3 | 4 | 5 |
|---|---|---|---|---|---|---|
| $k_h$ | $k_0 = 0$ | $k_1 = 12$ | $k_2 = 19$ | $k_3 = 24$ | $k_4 = 28$ | $k_5 = 31$ |
| $n_h = n + k_h$ | $n_0 = n$ | $n_1 = n + 12$ | $n_2 = n + 19$ | $n_3 = n + 24$ | $n_4 = n + 28$ | $n_5 = n + 31$ |
| $\Delta n_h = n_h - n_{h-1}$ | — | 12 | 7 | 5 | 4 | 3 |
| $2^{k_h/12}$ | — | 2 | 2.997 | 4 | 5.0397 | 5.993 |
| round($2^{k_h/12}$) | — | 2 | 3 | 4 | 5 | 6 |
| error | — | 0% | −0.11% | 0% | 0.79% | −0.11% |

Figure 4:
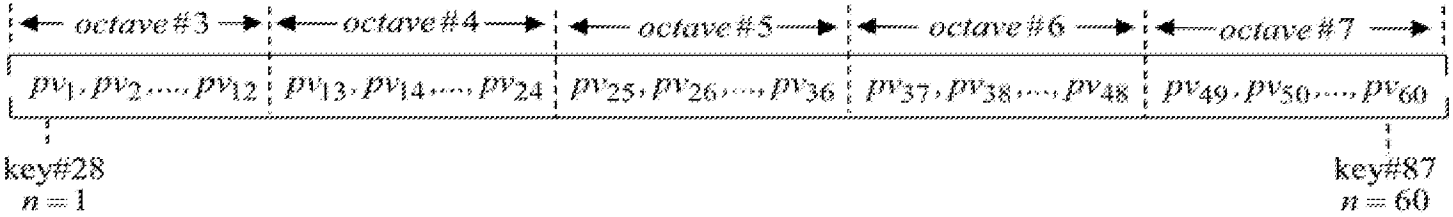
FIG. 4 shows the architecture of a perceptual power vector pv, according to one embodiment of the invention.

The central conclusion of Table 1 is the following: if two or more nonzero perceptual components in the pv of FIG. 4, corresponding to the keys with indexes $n_h$, are spaced from the key of index n according to the sequence $$\{n_h-n\}=[12,19,24,28,31],\ h=1,2,3,4,5 \tag{15}$$

then altogether as a group, they constitute a Fourier series whose fundamental frequency is the frequency of the key with index n. This is because all the members of a group of tones satisfying (15) comprises only harmonics of the fundamental frequency $f_n$. Note that the component of index n itself may be absent (may have value 0). The sequence (15) corresponds to the incremental sequence $$\{\Delta n_h\}=[12,7,5,4,3],\ h=1,2,3,4,5,\ \Delta n_h=n_h-n_{h-1} \tag{16}$$

If $\Delta n_h$ is known, then from Table 1 we get the relation $\Delta n_h=n_h-n_{h-1}=n+k_h-n_{h-1}$ thus the index of the key corresponding to the fundamental frequency $f_n$ of the Fourier series is $$n=\Delta n_h+n_{h-1}-k_h \tag{17}$$

The following two examples are provided for clarification:

Example I: assume that the dominant series consists of only two components corresponding to $pv_{15}$ and $pv_{22}$ in FIG. 4. Since 22−15=7=$\Delta n_h$, according to Table 1, h=2, $n_h$=22, $n_{h-1}$=15, $k_h$=19. Thus according to (17) the fundamental frequency corresponds to n=7+15−19=3, and according to (2), the melody tone corresponds to key #=28+3−1=30.

Example II: assume that the dominant series includes three components with frequencies corresponding to $pv_{37}$, $pv_{30}$, and $pv_{18}$. Since 37−30=7 and 30−18=12, then according to Table 1, all the three components belong to the same Fourier series. To compute n we may look at any of the differences. For instance, since 37−30=7 then 30 corresponds to the second harmonic, and we get, n=30−12=18, and key #=28+18−1=45. Alternatively, since 30−18=12, then, according to Table 1, the lower frequency is the fundamental, thus n=18 as before.

Of course, if the sequence contains only one component with index n, then the index of the fundamental frequency is the frequency of the key with index n. However, this case does not occur in practice, since there are always other components, although small, due to noise or other sounds. Nevertheless, as we see soon, the algorithm dealing with background perceptual power mentioned in (V) above handles this case as well.

The number of possible combinations is large, which a first sight looks as a daunting task. However, there is no need for complex computations. Once the vector pv is determined, the task of finding the dominant Fourier series may be carried out in a simple and automatic way.

Computing the Perceptual Power of the Candidate Fourier Series

To make things clear we show how this is done in the default illustrative example mode, which assumes that most of the perceptual power is contained in a H3 series. The case of series of larger size is obvious and immediate.

Let us construct a square selection matrix G, of dimensions equal to the dimension of pv $$G^{60\times 60}=\{g_{i,j}\},\ i,j=1,2,\ldots,60 \tag{18}$$

Let us build the matrix G for a H3 series in a way similar to FIG. 8 as follows: the first row of has all zero elements except $g_{1,1}$, $g_{1,13}$, and $g_{1,20}$, which are all set to +1, namely $$\{g_{1,j}\}_{j=1}^{60} \equiv [\underset{1}{1}, 0, \ldots, \underset{13}{1}, 0, \ldots, \underset{20}{1}, 0, \ldots, 0]$$

If we multiply pv by G we obtain a vector fs of dimension 60, whose first element $fs_1$ is given by $$fs_1=pv_1+pv_{13}+pv_{20}$$

A little thought reveals that the value of $fs_1$ is the perceptual power of the H3 Fourier series with fundamental frequency corresponding to n=1, namely, corresponding to key #28 in the illustrative example. This is because subtracting the first index from the second yields 12, and subtracting the second index from the third yields 7.

If now we build the second row of G in an identical manner, except that we shift all the 1's one place to the right, the value of the second element of fs, namely $fs_2$, will be the perceptual power of the H3 Fourier series with fundamental frequency corresponding to n=2, namely $fs_2=pv_2+pv_{14}+pv_{21}$.

If we continue to build the matrix in the same way, namely $$G \equiv \{g_{i,j}\} = \begin{cases} 1, & j \in \{i, i+12, i+19\} \\ 0, & \text{else} \\ i = 1, 2, \ldots, 60, & j \le i \end{cases} \tag{19}$$

Then the elements $fs_n$, n=1, . . . , 60 of the vector $$fs^{60\times 1}=G^{60\times 60}pv^{60\times 1},\ fs=[fs_1,fs_2,\ldots,fs_{60}]^t \tag{20}$$

consist of the perceptual powers of the Fourier series whose fundamental frequency corresponds to the key with index n=1, . . . , 60, which according to (2) corresponds to key #=28+n−1.

We note that instead of multiplying $\Delta\overline{p}_i^{[m]}$ by the perceptual coefficients $w_i^{[m]}$ as done in (12), we could equivalently have multiplied the elements of G by the proper perceptual coefficients, which leads to some saving in computational power, since this operation may be carried out once and off-line. However, this would require storing the matrix.

At this point we found the perceptual power of all the candidate Fourier series. What is left is to find out all the Fourier series of comparable perceptual power.

Determining the Dominant Fourier Series

The power of a strong background accompaniment is usually not concentrated in a single Fourier series. In absence of specific information regarding its nature, we assume that the background perceptual power is uniformly distributed over the components of the vector pv. A little though reveals that when computing (20) with a matrix G adapted for H3 series, if the global composite sound consists of only one nonzero components, without any noise added, the vector fs will consist of exactly 3 components of identical amplitude. Similarly, if G is adapted for H6 series, the vector fs will consist of exactly 6 components of identical amplitude. In this scenario, we pick up the Fourier series with the highest fundamental frequency. If the vector fs has one largest component, in absence of noise this component will correspond to the dominant Fourier series.

When the scenario includes also background noise, several fs components that would have had zero amplitude if the noise was not present, will be filled by components that don't belong to the melody. In this case, a wrong Fourier series may be dominant in power, and we may erroneously select it. To prevent this problem, we must define a measure telling us whether or not the difference in amplitude among the series is real, namely, due to the melody, in which case we should select the strongest series as the dominant one, or rather is the result of random noise add-up, in which case we should select the series with higher fundamental frequency and comparable power.

The measure we define, gives us an estimate of the perceptual background power relative to the value of the maximal fs component, and is defined as follows:

Compute the total absolute perceptual power (Pt), which consists of the sum of all the components $wabsp_i^{[m]}$ in (12)

$$Pt = \sum_{i=1}^{12} \sum_{m=0}^{4} wabsp_i^{[m]} \tag{21}$$

Find the largest component in fs, namely, find the Fourier series of strongest perceptual power $$fs_{max} = \max_{1 \le i \le 60} \{fs_i\} \tag{22}$$

Setting HN=3, 4, 5, 6 for a Fourier series H3, H4, H5, H6 respectively, define the separation coefficient (SC) as $$SC = \frac{Pt - fs_{max}}{fs_{max}} \times \frac{HN}{60} \tag{23}$$

The separation coefficient SC is a measure of how "far" the power of the strongest differential Fourier series detected is from the total absolute perceptual power.

The multiplication by HN/60 gives an estimate of the portion of the average "background" perceptual power one should expect to find in the strongest differential Fourier series.

In fact SC represents the estimated noise-to-signal ratio within the strongest Fourier series, thus, we take 1−SC as the estimated probability of correct detection, which therefore can be directly inferred from the melody threshold MT, and vice versa, since $MT=f_{smax}/P_t$. Therefore the estimated probability of correct detection 1−SC is used as the adjustable threshold value in lieu of MT in the illustrative example.

The Fourier series corresponding to the component $fs_i$ has comparable perceptual power if $$\frac{fs_{max} - fs_i}{fs_{max}} < SC,\ i = 1, \ldots, 60 \tag{24}$$

In other words, a Fourier series is comparable if its perceptual power differs from the strongest Fourier series by less than the sum of all the estimated noise components invading each one of the harmonics in the series.

The dominant Fourier series is the series of comparable perceptual power and highest fundamental frequency. If the power of the dominant series is above the melody threshold MT, then its index i corresponds to the detected tone. In practical applications SC in (24) may be replaced by α·SC where the value of a 1 is adjusted experimentally for optimal performance.

Chord Detection

The algorithm for performing chord detection runs in parallel and independently from the algorithm for melody detection. It makes use of the absolute (non-differential) estimates $\overline{p}_i^{[m]}$ discussed above.

For each $\overline{p}_i^{[m]}$, i=1, 2, . . . , 12, m=0, 1, 2, 3, 4 we compute the perceptual powers $$ch_{i+12(m-1)} = w_i^{[m]}\overline{p}_i^{[m]},\ i=1,2,\ldots,12,\ m=0,1,2,3,4 \tag{25}$$

as well as the total perceptual power $P_t$ in (12) which is also the sum of all the components in (25). Then we perform the modulo-12 computation on all indexes of $ch_{i+12(m-1)}$, and we add-up all the perceptual power values yielding the same index i following the modulo-12 operation. Since an increment of 12 indexes corresponds to doubling the frequency, in view of the previous analysis, the result is a vector $cr^{12\times1}$ of dimension 12, in which the value of each component consists of the sum of all the perceptual powers of the frequencies that are dyadic harmonics of the one of the 12 fundamental frequencies, namely $2^m f_k$, k=0, 1, 2, . . . , 11, and therefore they all sound as the same note at different octaves. If more than 60% of the total perceptual power in contained in three out of the 12 values, while the smallest value in not less than 10% of the largest value, and if the same detection occurs continuously again for a period of more than 138 msec, the algorithm in the illustrative example decides "chord detected", and outputs the three relevant indexes out of the possible 12. Then the algorithm checks several standard musical rules to decide whether the three detected tones may constitute a valid chord or are just a dissonance, an upon passing the check, it outputs the chord in the form of a group of three notes. Then following standard music rules, the combination of the three notes may be put in correlation with a specific chord denomination.

Detailed Construction of the $A_m$ Matrix According to the Example

The matrix $A_m$ of the illustrative embodiment has the form $$A_m^{S/2^m \times N} = \tag{26}$$

$$\{a_{i,j}^{[m]}\} \equiv \begin{cases} S = 1104, & t_s = 1/8000 \\ S/2^m \text{ rows}, & m = 0, 1, 2, 3, 4 \\ N = 24 \text{ columns (all matrices)} & \\ a_{i,2j-1}^{[m]} = \sqrt{\dfrac{2}{S/2^m}} \cos(\omega_j^m t_s i), & i = 1, 2, \ldots, S/2^m \\ a_{i,2j}^{[m]} = -\sqrt{\dfrac{2}{S/2^m}} \sin(\omega_j^m t_s i), & i = 1, 2, \ldots, S/2^m \\ \omega_j^m = 2\pi \times 110 \times 2^{(j+2)/12} \times 2^m, & i = 1, 2, \ldots, 12 \end{cases}$$

In words, the columns in the matrix related to the octave corresponding to index m, include samples of sine and cosine functions at the fundamental frequencies at that level for all the 12 keys belonging to that octave.

For s=1, 2, . . . , $S/2^m$ and for j=1, 2, . . . , N/2, the elements of the odd-indexed columns 2j−1 of matrix $A_m$, consist of the $f_s$-rate samples of a cosine function at frequency $f_{j,m}=110\times2^{(j+2)/12}\times2^m$ For s=1, 2, . . . , $S/2^m$ and for j=1, 2, . . . , N/2, the elements of the even-indexed columns 2j of matrix $A_m$, consist of the $f_s$-rate samples of a sine function at frequency $f_{j,m}=110\times2^{(j+2)/12}\times2^m$ multiplied by (−1).

All the columns of all the matrices $A_m$ are normalized so to have 2-norm equal unity. In other words, all the de-normalized sinusoidal functions belonging to the basis so normalized, have unit power.

In view of the relations $$V\cos(\omega t+\phi)=I\times\cos\omega t+Q\times\sin\omega t,\ V=\sqrt{I^2+Q^2},\quad \phi=\arctan(Q/I) \tag{27}$$

we see that using a combination of the columns of $A_m$, which include samples of sine and cosine functions, we are able to construct samples of a waveform consisting of a combination of 12 sinusoidal component of arbitrary amplitude and phase each, at octave #(m+3).

Contour Weights in the Illustrative Example

Figure 5:
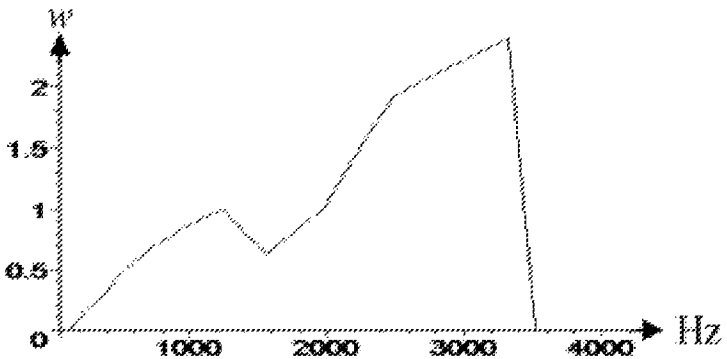
FIG. 5 shows the contour weights and the resulting weight function used in the description to follow to exemplify one embodiment of the invention.

The weight function generated by piecewise polynomial interpolation and the weights taken from the equal loudness contour are given in FIG. 5.

Hardware and Software

In order to be able to perform the process of the invention, the hardware and software employed must have the following minimal specifications: As pointed out before, the process of setting the optimal melody threshold includes a continuous mutual human-machine interaction, where the human hearing perception plays a significant role in optimally discriminating between accompaniment and melody, and the user adjusts the threshold until he hears the best detection of the melody. This interaction is a distinctive feature of the present invention. In fact, in many, if not most pieces of music, there is no mean of automatically deciding what sound belongs to accompaniment, and what belongs to melody, because melody is in many respects an interpretation of the listener with respect to the global effect of the all sounds present at a given moment, and the melody heard often does not belong to a single instrument, but is the result of a global perception (for instance when hearing a chorus). Thus the human hearing and the subjective perception of the user are the best (and often the unique possible) judge of whether the melody has been properly detected.

Since during the detection process all the possible Fourier series due to all the possible combinations of harmonics are checked, another distinctive feature of the invention is the capability to consider only the Fourier series whose fundamental frequency lies in some adjustable frequency range. This is done by setting lower and higher fundamental frequency boundaries, related to piano key fundamental frequencies, and named "Start End Keys", outside which any tone detected as melody will be discarded, thus reducing the risk of erroneous melody detection due to a strong instantaneous accompaniment level (such as a strong bass instrument, or a high guitar tone), and then fine-adjusting the boundaries "on the fly" until the melody detected is heard best. For instance, as pointed out before, in the case of a female soprano singer, whose fundamental voice frequency typically lies in the 261 Hz-1044 Hz range, the boundaries may be set a-priori so that all the Fourier series whose fundamental frequency lies outside the 261 Hz-1044 Hz range (about two octaves) will be discarded even if their perceptual power is the strongest. Then, the boundaries may be fine-adjusted "on the fly" by the user until he best hears the melody sung by the singer. In most cases, the melody will reside in a frequency range much smaller than the full two octaves, thus the "on the fly" adjustment guided by the user perception will lead to a much better result than to one obtained from the default range values.

In another instance, when playing the piano, the melody is mainly played by the right hand, and the accompaniment by the left hand. The user may want to hear the right hand alone, or the left hand alone. Setting the "Start End Keys" values the user may select the piano keys range that will be taken into account for the purpose of melody detection while all the other piano keys will be ignored. Therefore the user may discriminate between left and right hand, which effectively discriminates between melody and accompaniment.

Therefore the hardware should provide a) The means of generating musical sounds, such a loudspeaker (or equivalent)

b) The means of displaying rulers (or equivalent arrangement) where the user can see displayed b1) the melody threshold value b2) the frequency range boundaries values (Start End Keys)

b3) The specific musical time segment to be analyzed (start time, stop time)

c) A mean for the user to modify "on the fly" the values of c1) the melody threshold c2) the frequency range boundaries (Start End Keys)

The user will be able to modify the above settings following his perception of what values leads to the best melody detection. Such mean for modifying the values may be a mouse, a joystick, a touch screen, or equivalent ones.

d) Means of inputting the various default parameter settings (such as a keyboard or equivalent). Such default settings may be d1) The maximal length of the Fourier series, which is often dependent on the character of the music piece. For instance, detecting melody from a-cappella music, will require keeping many harmonics in the series, since the human voice is rich in harmonic content, while for a trumpet concert, the number of the harmonics kept must be small in order to better separate accompaniment from melody.

d2) The time segment to be analyzed. Different time segment of the same music piece may have very different character, and may require different threshold settings, or different setting in the number of harmonic. Therefore the user must be capable to isolate music segments of alike character to be analyzed. Isolating a music segment may be performed by setting the time segment to be analyzed.

d3) The previously mentioned melody threshold and frequency boundaries e) For real-time melody detection, sound-capturing means, such as a microphone are required.

f) Means of displaying/printing the sequence of the dominant fundamental tones, along with the time instant when said tone was detected. Optionally the corresponding chord denominations detected should be displayed when chord detection is used.

The software should provide a) Means of capturing the music piece to be analyzed, such as a recording algorithm. Subsequently the recorded file should be led to the proper format for analysis (for instance PCM-8 bit/sample, 8000 samples/sec in the illustrative embodiment).

b) Means of producing sounds corresponding to the detected melody and means of properly conveying the sound to the loudspeaker/earphones/other. Such means may consist of MIDI sound generation (MIDI—Musical Instrument Digital Interface. "MIDI 1.0 Specifications" is a technical standard that began in 1983, includes a large number of documents and specifications, and defines a protocol, a digital interface and connectors). Alternatively, the sound may be embedded using signal-processing means. It should be noted that the purpose of playing the sound in the invention is not to provide a computerized version of the melody in MIDI format (although this can be a by-product of the algorithm), rather, the purpose of playing the melody detected is to allow the human-machine interactions previously described, in virtue of which the user is able to optimize the detection of the melody, by interactively adjusting the melody threshold and the fundamental frequency range, until he is satisfied with the melody heard, and feels that he reached the best possible (or a satisfactory) melody detection. Therefore, the human hearing judgment is an inherent part of the algorithm itself, and an important input to the algorithm convergence. This human-machine interaction is a distinctive feature of the invention.

c) Means of accepting and modifying "on the fly" the parameter setting previously mentioned, including, among others, melody threshold, fundamental frequency range, and Fourier series length. The modifications should be capable to affect the algorithm "on the fly".

c) Means of generating vector bases of the type mentioned before, while various sets of vector bases may be optionally generated so to be able to accommodate mistuned instruments. In other words, the algorithm should optionally generate various sets of vector bases, each slightly "mistuned", and choose to use the one that is best adapted, in the sense that it yields the largest value when summing up all the non-perceptual absolute power components defined in equation (10). Doing so the detection may be optimized even for mistuned instruments or voice (for instance, this may occur when someone adjusts a guitar without hearing first a reference tone, or sings on a mistuned scale).

Example: User Interactivity

Figure 6:
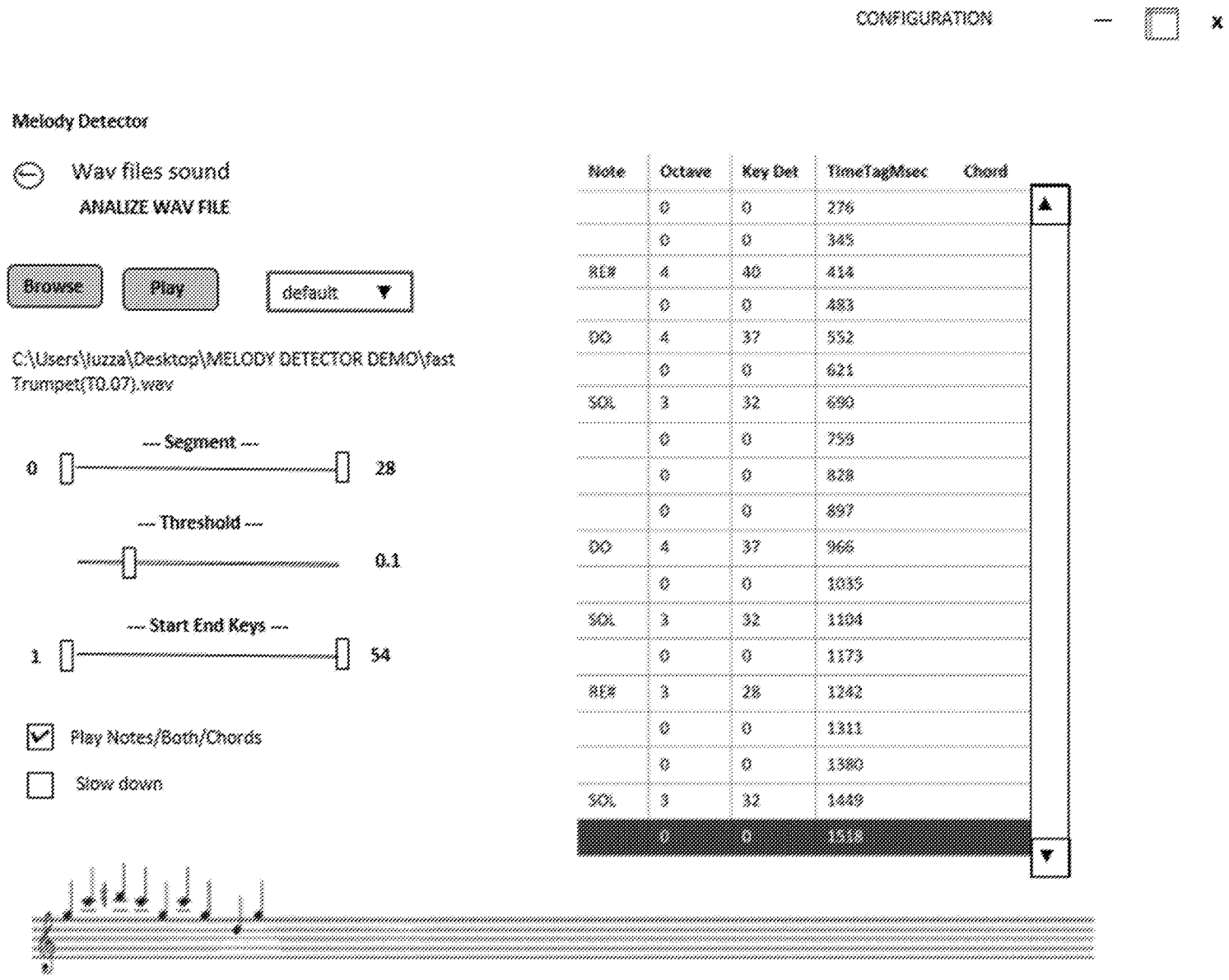
FIG. 6 shows an exemplary user panel, according to one embodiment of the invention.

The invention allows for operation in an automatic default mode, namely, using a default "set of parameters" (melody threshold, fundamental frequency range etc.) that have been setup by the user so to be well adapted to the music style he deals with. However, as pointed out before, in order to obtain more personalized and optimal performance, the process may be operated interactively. A snapshot of an illustrative user panel, according to one embodiment of the invention, is shown in FIG. 6 Interactive operation can be performed, using the illustrative specific example of FIG. 6, according to the following:

(I) The process works in real time and upon detecting a melody note, outputs the corresponding MIDI sound to the local speakers, thus the user hears the actual melody detected. As pointed out, the user may adjust "on the fly" the set of parameters, one at the time until he hears the best MIDI reproduction of what is the melody at his perception. The parameters may be re-adjusted repeatedly, by re-playing the selected time segment, until the user feels that he got the best result.

In an embodiment of the invention, if the user in interested in finding out suitable chords for the detected melody, the embodiment is able to use the MIDI process to play detected chords along with the melody. It should be noted that, by analyzing the sounds present, the illustrative embodiment may be able to suggest chords even when no intentional chord was actually played in the piece of music, provided that a valid chord has been detected. Thus, is necessary to allow the user hearing perception to decide whether a suggested chord fits the melody.

(II) In several occasions a piece of music may include a strong accompaniment, as in the case of a solo instrument playing along with a strong orchestra. Generally the solo instrument will be perceptually somewhat above the accompaniment, however the relative perceptual loudness depends on the particular piece of music. As explained before, the user may manually adjust the melody threshold "on the fly". The illustrative user panel includes a slider named "Threshold" that the user may adjust on the fly until he best hears the melody alone and best leaves out the background accompaniment. When he moves the slide what happens is that the melody threshold discussed before is immediately updated, so that, as explained at the beginning of the "Hardware and Software" paragraph, only tones with perceptual power above the threshold are considered as candidate Fourier series. Therefore, the user may adjust the threshold so to leave out tones that belong to accompaniment.

(III) As pointed out before, when playing the piano, for instance, the melody is mainly played by the right hand, and the accompaniment by the left hand. The user may want to hear the right hand alone, or the left hand alone. The illustrative user panel includes a two-edge slider named "Start End Keys". The user may set the slider edges to select the piano keys range that will be taken into account for the purpose of melody detection (see FIG. 3), while all the other piano keys will be ignored. Therefore the user may discriminate between left and right hand, which effectively discriminates between melody and accompaniment.

(IV) In the illustrative user panel, when listening to a singer with a strong accompaniment, the user may dramatically improve the melody detection using the "Start End Keys" slider. This is because the singer voice covers a known frequency range of usually less than two octaves. By setting the keys range to cover the singer voice range, the user may leave out a considerable portion of the orchestral accompaniment, thus improving the detection of the melody determined by the singer voice. Moreover, the user may interactively fine-adjust the slider on the fly until the real-time MIDI reconstruction sounds the best to him, as discussed in detail at the beginning of the "Software and Hardware" paragraph.

(V) The exemplary user panel includes a two-edged time slider that allows the user to choose a particular time segment that he wants to analyze. This is particularly useful when a music file covers a long time. The time edges parallel the time in seconds as shown by all standard music players, so all the user has to do is select the time segment, say, on the Windows Media Player, and set the time slider accordingly.

(VI) The illustrative user panel includes a checkbox allowing to select the option to hear the melody alone, the chords alone, of the melody and the cords simultaneously. As previously discussed, the detected melody, and the detected chords are available altogether. The checkbox simply defines what detected values will be passed to the MIDI sound generator, whether the melody alone, the chords alone or both, depending on what the user is interested to find out. Recall that, as pointed out before, playing the detected melody is an essential action in order to allow the user to refine the parameter settings "on the fly" to obtain the best detection at his perception, and playing the detected chords is essentially to allow the user to decide, at his perception, whether or not the proposed chords fit the melody.

As will be apparent to the skilled person, the invention permits to obtain a result that, before the invention, was impossible: using the invention anyone can take a piece of recorded music from any source and, without any prior knowledge of it, obtain on the fly the melody of that music, even in many cases where there is no single instrument playing it. This result is of paramount importance to musicians and to dilettantes alike, since it significantly increases their ability to understand melodies they heard and liked, and to play them on their instruments of choice at the best of their perception.

All the above description has been provided for the purpose of illustration and is not intended to limit the invention in any way. All the principles of the invention can be applied to different sounds, instruments, types of music, etc. without exceeding the scope of the invention.

The invention claimed is:

1. A method for performing melody detection by interpreting the global effect of a musical sound, comprising the steps of:

(I) defining a hierarchical basis consisting of the collection of a set of bases, where the elements of each basis consist of vectors of values corresponding to time-domain samples of sinusoidal functions, each of frequency corresponding to the fundamental frequency of a musical note up to the frequency limit imposed by the sampling rate used;

(II) sampling the musical sound during time segments of predefined duration, at a predefined sampling rate, and arranging the values of the samples in blocks, each covering the corresponding time segment, where different blocks may overlap in time, in the sense that they may include common samples;

(III) for each block of samples, determining a set of coefficients, each one related to a corresponding vector in the above hierarchical basis, so that the linear combination of the vectors in the hierarchical basis, each multiplied by the corresponding coefficient, constitutes a time-domain representation of the musical sound within the time segment corresponding to the block of values;

(IV) Performing Steps (II) and (III) above, over subsequent time segments, so to cover a predefined time duration of the musical sound;

(V) Based on the sets of coefficients determined in Step (III) for subsequent time segments, determining a sequence of musical notes that are estimated to be dominant according to predefined rules; and (VI) optionally providing a printout of said sequence of musical notes in the form of a musical sheet or a text printout symbolizing said sequence of notes.

2. The method according to claim 1, comprising the steps of:

(VII) determining the set of coefficients in Step (III) by carrying out a series of time-domain Least-Squares (LS) processes, so to obtain an optimal time-domain representation of the musical sound;

(VIII) based on the coefficients obtained in Step (VII) for each one of the fundamental frequencies in Step (I), determining the perceptual power of the associated sinusoidal components in the optimal time-domain representation of the musical sound;

(IX) computing the total perceptual power by summing up the perceptual power of all the sinusoidal components in Step (VIII);

(X) keeping only the incremental perceptual power of the sinusoidal components the amplitude of which is growing with time, and discarding sinusoidal components the amplitude of which is steady or decaying in time;

(XI) performing the following sub-steps:

(a) building a perceptual power vector whose elements consist of the values of the perceptual powers obtained in Step (X) for each sinusoidal component, arranged top-down by increasing frequency, and building a selection matrix of dimension equal the above perceptual power vector;

(b) determining the fundamental frequency and the cumulative perceptual power of all the groups of sinusoidal components in Step (VIII) that can be grouped so that their frequencies are all integer multiples of the fundamental frequency of one particular musical note, which is lower or equal to the frequency of one component in the group, and therefore, as a group, constitute a Fourier series, and where each sinusoidal component participates in more than one group;

(c) locating the Fourier series of largest perceptual power, and setting its perceptual power as the peak perceptual power; and (d) if the peak perceptual power is below the melody threshold, then going back to Step (VII);

(XII) computing the background perceptual power present in the Fourier series relative to peak perceptual power;

(XIII) denoting by Fourier series of comparable power all the Fourier series among those determined in Step (XI), the perceptual power of which is greater than the peak perceptual power minus the background perceptual power;

(XIV) taking the Fourier series of comparable power having the highest fundamental frequency as the dominant Fourier series, and taking the corresponding instant as the time of occurrence of the tone; and (XV) optionally, performing chord detection; and (XVI) optionally keeping the non-incremental power instead of the incremental power when the melody to be detected is generated by nearly steady or prolonged sounds.

3. The method according to claim 2, wherein Step VII is carried out about 15 times every second, using a novel set of multiple bases as described in Step (I), and wherein each of the vectors belonging to the same basis includes a number of samples large enough so to cover a time segment at least equal to the reciprocal of the smallest frequency separation between each two frequencies of the sinusoidal functions of Step (I), so to satisfy Heisenberg's uncertainty principle, thereby to allow detecting each corresponding frequency component in the shortest possible time, and where the sets of bases are replaced by different sets of "mistuned" multiple bases in order to accommodate mistuned instruments or voices.

4. The method according to claim 2(IX), further comprising setting a melody threshold as a given percent of the total perceptual power, or a correct detection probability threshold (directly derived from said melody threshold) thereby allowing to detect the presence of melody above a strong background.

5. The method according to claim 4, wherein the melody threshold is set in the 10%-50% range.

6. The method according to claim 2(X), wherein the difference between the power of each frequency component in the optimal detection, and the power of the same frequency component found in a previous optimal detection are computed and, if the difference is positive this difference is assigned as the differential power of the sinusoidal component at the given frequency; otherwise, the differential power is set to zero.

7. The method according to claim 2(XV), wherein a chord is detected by looking at all the groups of at least three simultaneous long-lasting groups of tones having mutually different fundamental frequency and finding the dominant chord by summing up the perceptual power of the fundamental tone and of all the dyadic tones related to each group, and selecting the group that has the largest total perceptual power.

8. The digital storage apparatus according to claim 2, comprising a selection matrix, which is designed to identify the fundamental frequency of each musical note with the frequency of a harmonic component of a lower musical note, whenever, in view of Heisenberg uncertainty principle, the two frequencies are close enough so that the two frequencies cannot be distinguished within the minimal period of time required for the detection of a note, and, when multiplied by the perceptual power vector found in Step (XI) (a) of claim 2 with the least-squares process in Step (VII) of claim 2, generates a vector of N component values, where the value of the nth component corresponds to the cumulative power of one of the Fourier series in Step (XI) (b) of claim 2, the fundamental frequency of which corresponds to the nth key.

9. The digital storage apparatus of claim 8, wherein the selection matrix is a 60 by 60 matrix, comprising a first line consisting of 60 values which are all zeros except the first, $13^{th}$, $20^{th}$ and the $25^{th}$ values which are 1, and wherein line number n is identical to the first line but with the 1 values shifted to the right by n places, and wherein if a 1 is shifted beyond place 60 is discarded.

10. The method according to claim 1, wherein the interpretation is carried out using all the octaves of a standard piano keyboard.

11. The method according to claim 1, wherein the interpretation is carried out using only part of the octaves of a standard piano keyboard.

12. The method according to claim 11, wherein the interpretation is carried out using the four and a half octaves starting at the third octave of a standard piano keyboard.

13. The device for performing melody detection according to claim 1, comprising a CPU, adapted to carry out the Least-Squares process in Step (VII) and the associated mathematical operations, and memory means associated with said CPU, which memory means contain the vectors constituting the hierarchical basis in Step (I), as well as related information about the fundamental frequencies of all or of part of the keys of a standard piano keyboard.

14. The device according to claim 13, which is adapted to analyze a streaming audio in blocks of 1104 samples at the rate of 8000 samples/second resulting in a processing time of 138 milliseconds per block or longer.

15. The device according to claim 13, wherein the memory location stores samples of signals at fundamental frequencies of each of 12 keys of an octave.

16. The device according to claim 13, wherein a first set of symbols stored in the CPU memory locations refers to the standard symbols associated with musical notes.

17. The device according to claim 13, wherein each set of symbols stored in the CPU memory locations allocated to store the vectors in the hierarchical basis in Step (I), contains two vectors of values for each musical frequency, one containing samples of a sine function at the frequency corresponding to the associated piano key, and the second containing samples of a cosine function at the frequency corresponding to said key.

18. The device according to claim 17, wherein each of said vectors of values consists of 1104 samples that have been computed beforehand.

19. The method according to claim 2, wherein when the musical sound consists of prolonged sounds Step X is skipped and the incremental perceptual power is set equal to the perceptual power as obtained in Step (VIII).

20. The method according to claim 2, wherein the perceptual power is replaced by the sum of the powers of the associated sinusoidal components.

* * * * *